US005318491A

United States Patent [19]

Houston

[11] Patent Number: 5,318,491

[45] Date of Patent: Jun. 7, 1994

[54] MULTIPLE MODE TUG OF WAR EXERCISE MACHINE

[76] Inventor: Vincent Houston, 33 Holland Pl., Hartsdale, N.Y. 10530

[21] Appl. No.: 963,389

[22] Filed: Oct. 19, 1992

[51] Int. Cl.[5] ..... A63B 69/00

[52] U.S. Cl. ..... 482/54; 482/4; 482/36; 482/33; 482/71; 482/906; 273/451

[58] Field of Search ..... 482/4–8, 482/23, 36, 37, 51–54, 70–73, 92, 902, 906; 273/451, 452

[56] References Cited

U.S. PATENT DOCUMENTS

| | | | |
|---|---|---|---|
| 2,884,248 | 4/1959 | Tenney | 482/906 X |
| 3,782,718 | 1/1974 | Saylor | 482/37 |
| 4,659,077 | 4/1987 | Stropkay | 482/120 X |
| 4,674,741 | 6/1987 | Pasierb, Jr. et al. | 482/902 |
| 4,776,323 | 10/1988 | Spector | 482/3 X |
| 5,000,440 | 3/1991 | Lynch | 482/54 |

FOREIGN PATENT DOCUMENTS

| | | | |
|---|---|---|---|
| 672583 | 10/1963 | Canada . | |
| 378581 | 8/1932 | United Kingdom | 482/62 |

*Primary Examiner*—Richard J. Apley
*Assistant Examiner*—Glenn E. Richman

[57] ABSTRACT

A tug of war machine is described which includes a belt loop which is pulled in a generally horizontal direction. The resistance placed on the loop can be selected to either provide a static pull or a hand-over-hand tug of war-type pulling exercise. Additionally, a treadmill may be used in conjunction with the tug of war loop cord to provide simultaneous exercise for the legs and the back. A monitor displays the performance of the user and compares this performance with the effort relative to a predetermined standard of reference.

20 Claims, 3 Drawing Sheets

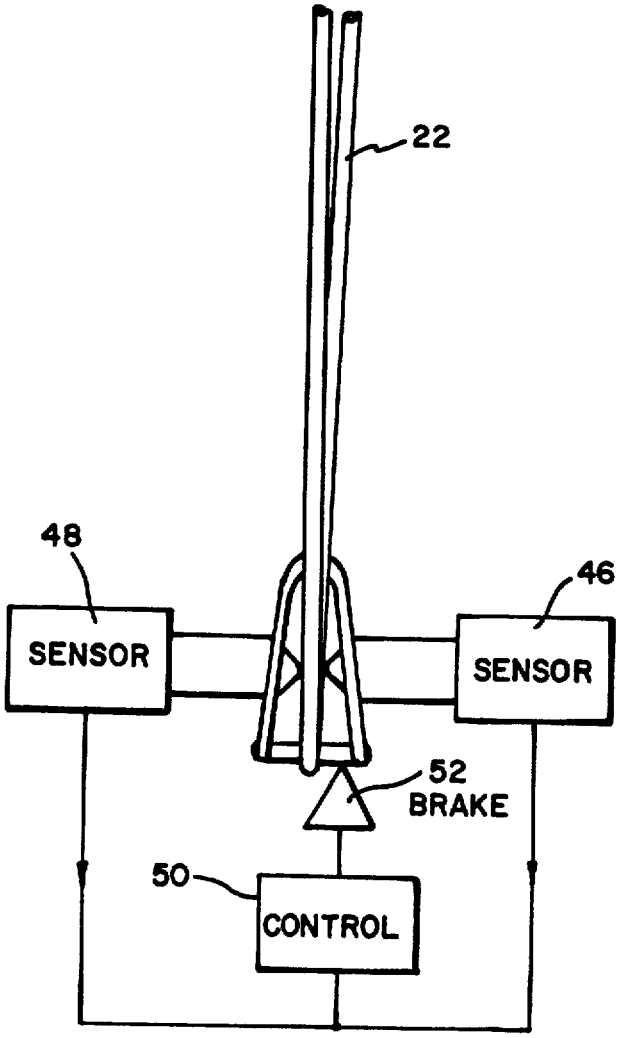
FIG. 3
FIG. 5
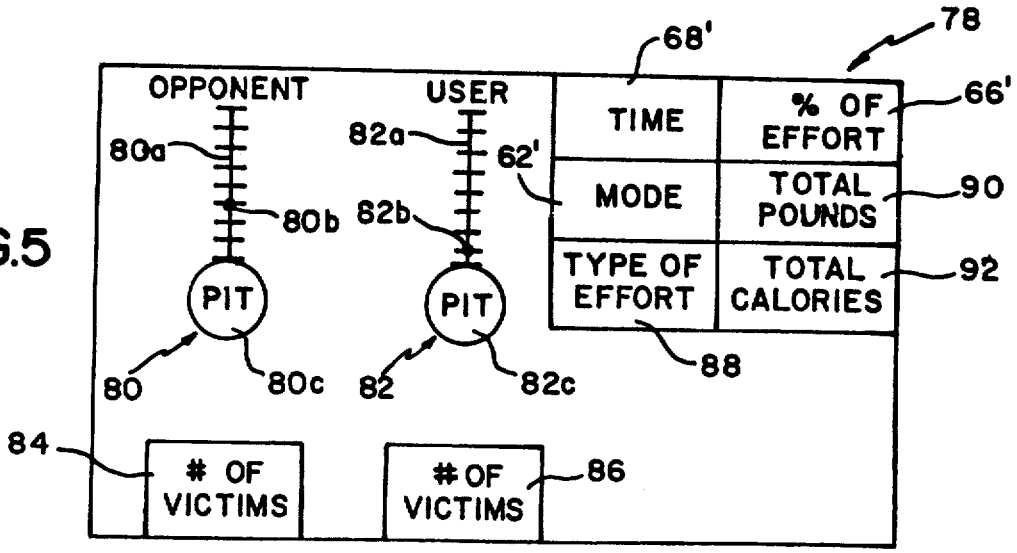

MULTIPLE MODE TUG OF WAR EXERCISE MACHINE

BACKGROUND OF THE INVENTION

1. Field of the Invention

The invention generally relates to the field of exercise machines and, more particularly, the invention relates to a multiple mode tug of war exercise machine useful in providing isometric, isotonic, isokinetic, and special accommodating resistance for continuous aerobic exercise.

2. Description of the Prior Art

Various devices have been developed both for testing and for exercising specific muscle groups. For example, in U.S. Pat. No. 4,674,741 to Pasierb, Jr. et al., an exercise rowing machine is disclosed which has a video display. The machine is intended to exercise and develop the user's legs, back, shoulders, arms, and other areas of the body without excessive stresses being applied, for example, to the knees.

In U.S. Pat. No. 4,822,036, an isokinetic exercise machine is disclosed which generates resistance that is a sum of two components: isotonic and isokinetic resistance. The isotonic component is independent of motion speed and the isokinetic increases with motion speed when the motion speed exceeds a pre-selected level. The machine includes a handle which can be held in the user's hand for creating a substantially downward directed pulling force. The patent mentions that the exercise can also be used to strengthen the legs and illustrates a combination of isotonic and isokinetic resistance.

An isokinetic exercise and monitoring machine is disclosed in U.S. Pat. No. 4,565,368. The machine described in this patent is primarily directed to an isokinetic exercise and monitoring machine for use in exercising and monitoring the back muscles of an individual. The upper portion of the individual's body, above his waist, is restrained by one restraining means while the individual's lower body, below his waist, is restrained by another restraining device.

U.S. Pat. No. 4,848,152 is primarily concerned with measuring a person's lifting capacity for determining a users maximum lifting capacity. For this purpose, the machine includes a handle and cable for user input. The user exerts force against the handle which is fixed to the cable, the person seeking to lift or pull the handle and cable in a substantially vertical upward direction. Dynamic testing techniques, of the type disclosed in this patent, are used to develop isokinetic exercise apparatus in which the user moves at a constant velocity regardless of the amount of resistance that is applied. A visual display has a CRT screen positioned for viewing by the user thereby achieving biofeedback to the user of the lifting technique. This patent also cites numerous other patents which disclose related constructions for operating in an isotonic (constant force) mode, isotonic or isometric modes; programmable acceleration, preselected acceleration and constant velocity patterns. The machine of the patent discloses a vertical lift device used as a means of assessing leg and back strength.

SUMMARY OF THE INVENTION

It is, accordingly, a primary object of the present invention to provide an exercise machine which simulates a tug of war which is used by engaging an elongate member and pulled in a generally horizontal direction.

It is another object of the invention to provide an exercise machine which can be operated in multiple modes to exercise different muscle groups.

It is still another object of the present invention to provide an exercise machine of the type suggested above which is simple and convenient to use.

It is yet another object of the present invention to provide an exercise machine of the type under discussion which is enjoyable to use and simulates a tug of war contest against an actual or imaginary contestant.

In order to achieve the above objects, as well as others which will become apparent hereafter, a tug of war exercise machine in accordance with the present invention is used to exercise an individual standing in a generally upright position. The machine includes a stationary support means generally at a height within the range of the reach of an individual's hand while in a standing exercise stance. Force responsive means is provided on said support means. Elongate pulling means is coupled to said force responsive means and available to be engaged by the individual and pulled in a generally horizontal direction away from said support and force responsive means. Indicating means is provided which cooperates with said force response means for providing an indication on as to the effort of the individual relative to a predetermined standard or reference.

BRIEF DESCRIPTION OF THE DRAWINGS

The above and other objects, advantages and features of this invention will be apparent from the following description taken with reference to the accompanying drawings, wherein there is shown a preferred embodiment of the invention:

FIG. 3 is a diagrammatic view of sensors and controls which may used with the apparatus shown in FIG. 2;

FIG. 5 is a pictorial view of a screen which may be displayed on a monitor of the unit shown in FIG. 1.

DESCRIPTION OF THE PREFERRED EMBODIMENT

Figure 1:
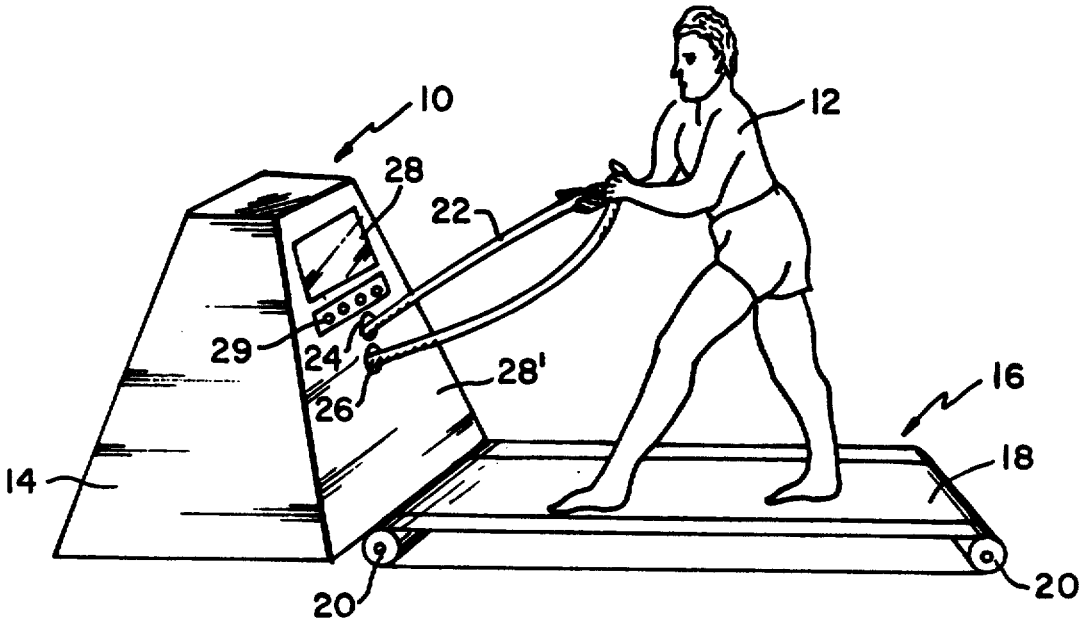
FIG. 1 is a pictorial representation of a user operating a tug of war exercise machine in accordance with the present invention.

Referring now specifically to the figures, in which identical or similar parts are designated by the same reference numerals throughout, and first referring to FIG. 1, the tug of war exercise machine in accordance with the present invention is generally designated by the reference numeral 10. The person 12 doing the exercise generally faces an upright console 14 which serves as a stationary support for the mechanical components and electronics which are used in conjunction with the machine.

An important feature of the invention is that the individual using the machine stands in a generally upright position. The console 14 is generally at a height within the range of the reach of an individual's hands while in a standing exercise stance, for reasons which will become evident from the discussion that follows.

While the tug of war exercise machine may be used without it, the presently preferred embodiment preferably includes a treadmill 16 which the individual 12 stands. The treadmill 16 includes a movable belt 18 mounted on rollers 20. The treadmill 16 is arranged proximate to the console 14 as shown in FIG. 1.

An important feature of the invention is the provision of an elongate pulling means in the form of a cord, rope or the like 22 which is coupled to the mechanism inside the console 14 and available to be engaged by the individual and pulled in a generally horizontal direction away from the consol 14. While it will become evident that for purposes of some of the exercises, the element 22 may be a single cord or rope the elongate element 22 in the preferred embodiment is in the form of a closed loop as suggested in FIGS. 1 and FIG. 2. For this purpose, the front panel or side facing the individual 12 is provided with upper and lower openings or holes 24,26 respectively, for allowing passage of the upper and lower portions of the continuous or loop element 22. The opening for the loop can be a single slot opening. The front panel 28' is also provided with a monitor 28 as well as a control panel 29 which allows selection of the parameters, modes, etc. in which the machine is to be used.

Figure 2:
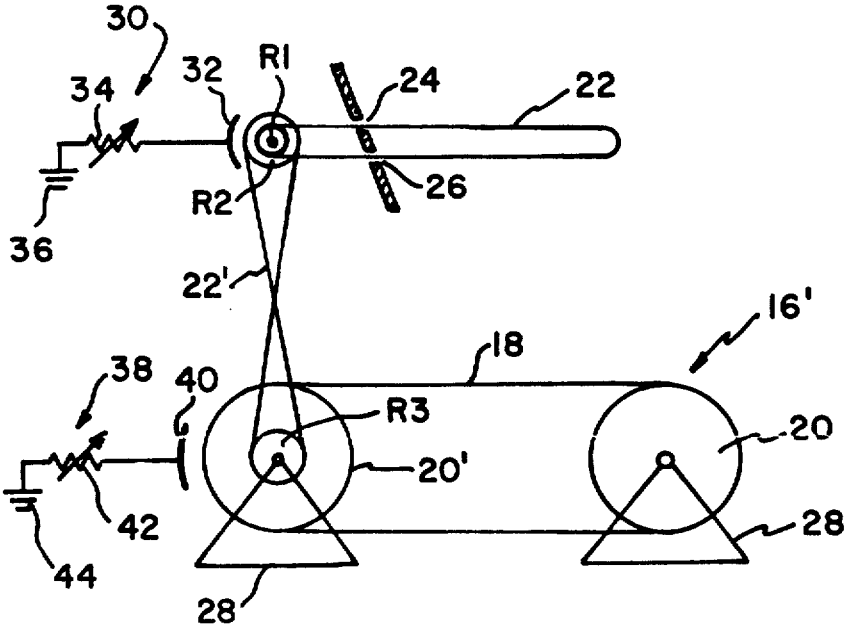
FIG. 2 is a diagrammatic view of the tug of war machine shown in FIG. 1, showing the manner in which the cord being pulled by the individual is coupled to or cooperates with the force modifying devices, and how it may cooperate with a treadmill.

In FIG. 2, the loop 22 is shown to be engaged with roller R1 which is coupled with a large diameter roller R2. A belt 22' engages the large diameter roller R2 at the upper end and a lower roller R3 at the lower end. The roller R3 is, in turn, selectively coupled as with a clutch to roller 20' of a treadmill 16', the belt 18 being engaged with roller 20 of the treadmill. The rollers 20, 20' are shown mounted at their pivot shafts on supports or stands 28, not shown in FIG. 1, which permit the rollers 20, 20' to rotate with the belt 18 above the level of the floor.

The loop 22 as well as the treadmill belt 18 can either be fixed so that they cannot move at all or can be moved under controlled conditions. The specific manner in which the rollers R1, R2, R3 and 20 are fixed in place or moved under controlled resistance is not critical for purposes of the present invention, and any suitable and known means for applying resistance to these belts and rollers may be used. Representative of the resistance that can be applied to the loop 22 is resistance 30, which includes a brake or clutch 32 which can cooperate with the roller R2. The brake or clutch 32 can be forced against the roller R2 with variable force by adjustable resistance 34 which acts between the brake or clutch 32 and a fixed member 36. Similarly, a resistance device 38 can include a brake or clutch 40 which engages or acts upon roller 20', being urged against the roller by means of adjustable or variable resistance 42 acting between the brake or clutch 40 and a fixed member 44. The variable or adjustable resistances 34, 42 can take any one of a number of different forms, including manually adjustable compression springs, hydraulic pistons or the like. The aforementioned elements can be either manually adjusted or controlled in accordance with a predetermined program selected by the individual 12 by means of controls 29. For example, referring to FIG. 3, a sensor 46 is shown diagrammatically for sensing the tension in the cord 22, while a sensor 48 is used to measure the velocity with which the cord is being pulled. Devices for measuring forces and velocities are well known to those skilled in the art, as exemplified by the references identified in the Background Of The Invention. The outputs of the sensors 46, 48 are inputted to a control circuit 50 which is programmed by the individual 12 by means of controls 29, and an output is applied to a brake or clutch 52 which controls the permissible velocity and the tension in the loop cord 22. In this connection, it is pointed out, as suggested above, that the specific mechanisms for sensing tension and velocity as well as for controlling the resistance and permissible velocity of the string 22 are generally well known in the art. Thus, clutches or brakes and sensors are disclosed in the U.S. Pat. No. 4,848,152 issued to Pratt Jr. A system for governing the resistant output of a brake which provides both isokinetic and isotonic resistance simultaneously is disclosed in U.S. Pat. No. 4,822,036 issued to Dang. A dynamometer is utilized in U.S. Pat. No. 4,565,368 issued to Boettcher, which can also be used to provide isokinetic or accommodating resistance. One type of electro-mechanical isokinetic machine is available from Cybex Co. of Ronkonkoma, N.Y., a division of Lumex, Inc. The Cybex machine also includes an electro-mechanical dynamometer. A rotating fly-wheel is used to convert energy from the user into rotation of the fly-wheel, as disclosed in U.S. Pat. No. 4,674,741 issued Pasierb, Jr. et al. A variable force can be applied during portions of the stroke. It will be clear, therefore, that the aforementioned patents as well as those patents which are referenced in those patents disclose a multitude of resistance applying mechanisms which can be used, in various combinations, to vary or control the resistance exhibited by the loop belt 22 as well as the belt 18 of the treadmill 16'.

The tug of war exercise machine has the ability to be used in four different modes, which will preferably be selected by means of controls 29 and displayed on the monitor 28. The amount of effort generated can be monitored on the display monitor to provide real time feedback and encourage competitive attitudes in the user. Several resistance modes can be used, including isometric, isokinetic, isotonic and special accommodating resistance for continuous aerobic exercise. Thus, the four modes of operation are: (1) static pull with no moving parts to measure the force of an isometric pull. Here, the belt loop 22 is fixed in place by the locking or braking of the roller R1. In this mode, the belt 18 of the treadmill 16 is also fixed in place so that the individual 12 can have the necessary stability on the treadmill to apply relatively large forces to the loop 22. (2) Dynamic pull with a moveable cord that is used as a back and arm exercise device. Here, the treadmill is still locked in place. However, the individual can pull the upper portion of the cord 22 in a hand-over-hand fashion. Since the legs are stationary during this exercise, the back and arms obtain isokinetic exercise and the legs obtain isometric exercise. This mode could be used for wheelchair bound individuals to develop upper body strength. (3) Static pull on the cord with a movable treadmill that is used as a back and leg exercise device. Now, the treadmill 18 is enabled so that the belt 18 moves allowing the user to walk in a backward motion while holding onto a stationary cord 22. This exercise provides isometric exercise for the arms and back, and isokinetic exercise for the legs. (4) Dynamic pull with both a movable cord and treadmill belt to provide total isokinetic body exercise. The arms moving in the hand-over-hand motion and the legs in a backward walking motion.

As suggested, the various forces and velocities can be controlled so as to customize the exercise and the muscle groups being utilized. The cord 22 and the belt 18 can be adjusted and may be selected, for example, within a range of (1-15 ft/sec). The speed and the force can also be adjusted such that the velocity times the force applied is substantially a constant value, such as disclosed in U.S. Pat. No. 4,565,368.

The video display 28 is not critical and any visual indication may be used. In this connection, it may also be noted that audio output or feedback can be provided. For example, it is possible to utilize a tone the pitch of which changes as the individual's effort approaches the predetermined or set reference quantity. It is also possible, along these lines, to provide voice output by utilizing synthesized speech which can provide the individual feedback on his or her performance and can encourage the user in the activity.

Figure 4:
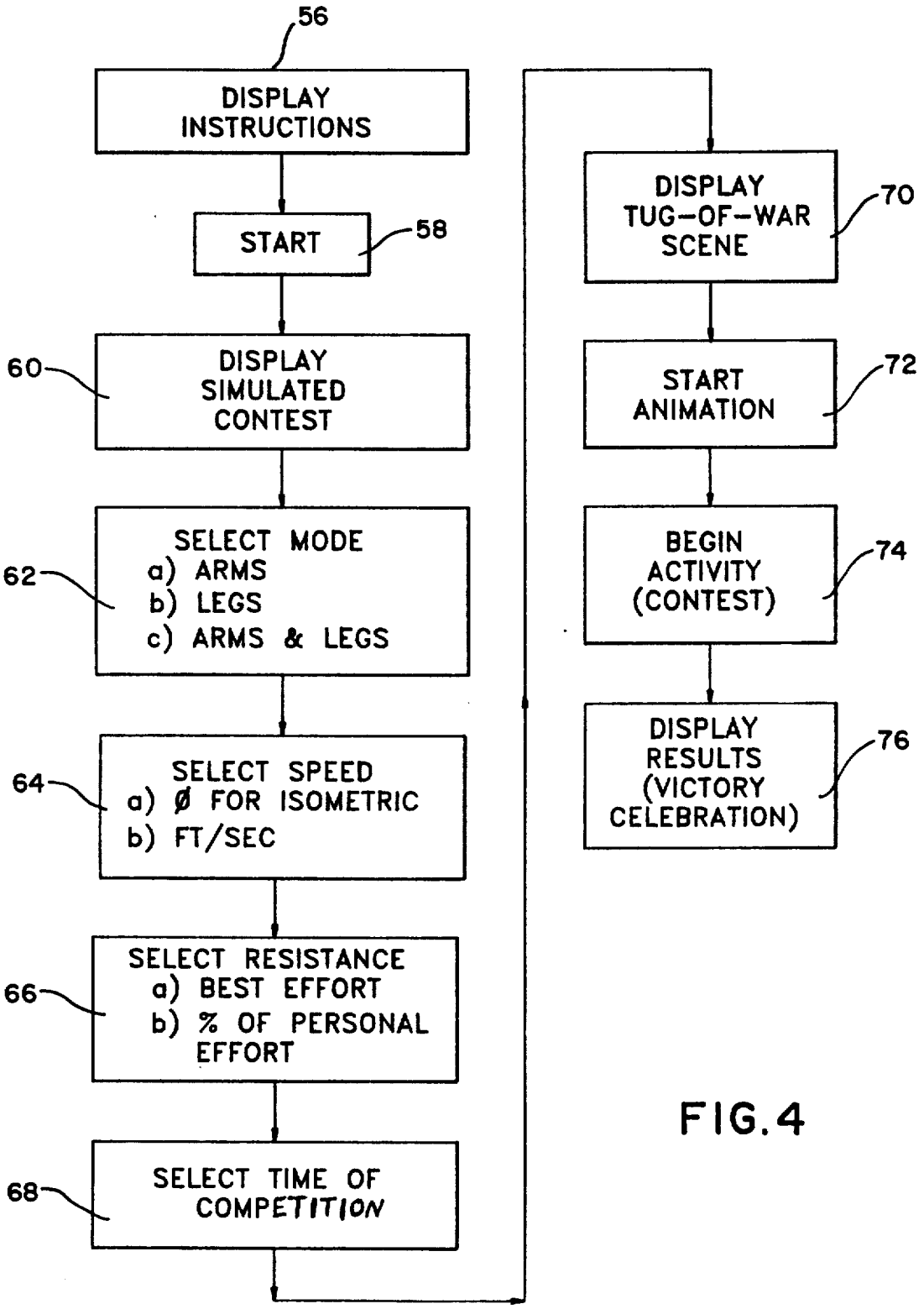
FIG. 4 is a flow chart illustrating the sequence of steps that can be taken in the operation of the tug of war unit shown in the previous figures.

Referring to FIG. 4, a flow chart is illustrated which provides a suggested sequence of events in the use of the tug of war machine. Thus, the individual may request a display of instructions, at 56. The contest can commence by pressing an appropriate start button, at 58. Simulated contest can be displayed at 60, after which the user can select a mode to be used, at 62. Thus, the user may select that the arm muscle, leg muscle, or both are to be exercised. If only the arms are to be exercised, the belt 18 can be fixed in place, as suggested above. If only the legs are to be exercised, the loop 22 can be fixed in place and only the treadmill made to operate. When all of the muscle groups are to be exercised, both the loop 22 and the treadmill belt 18 are all set into motion. Once the mode is selected, the individual can select the speed at which the loop 22 will move. The user can select zero speed if an isometric exercise is preferred, while a fixed speed, in feet per second, or in meters per second, can be selected for normal use. At 66, the user can select the nature and the degree of resistance that will be encountered in the loop belt 22. A the best effort, a percentage of ones best effort, or a specific resistance in ft/lbs, watts, or other known resistance could be selected. Lower initial resistance level could be selected by those who are beginning to exercise with the device and as stamina is built up the resistance could be increased. At 68, a time period for the exercise can be selected. After the mode, speed, resistance and time have been selected at 62, 64, 66, and 68, the device displays a tug of war scene on the monitor 70, at which animation will start at 72 and the activity or contest will begin at 74. After the selected time period has been completed, the unit can display the results, at 76.

Referring to FIG. 5, one example of a tug of war display scene that can be used is designated by the reference numeral 78. In this scene, opponent and user zones 80, 82, respectively, are shown. The opponent's region includes a calibrated track or path **80*a* on which the position of the opponent 80*b* is shown. If the opponent's performance falls short of the user's performance, in accordance with predetermined parameters or selections, the opponent will come closer and closer and finally fall into the pit 80*c*. Similarly, a calibrated path or position 82*a* is shown in which the position of the user 82*b* is indicated. Performance which falls short of the selected parameters causes the user to come closer and closer ultimately fall into the pit 82*c*. This display is repeated during the selected time period, the number of opponent victims being indicated at 84 and the number of times that the user has fallen into the pit is illustrated at 86. In this connection, the screen 78 can also display the time 68', the mode 62' and percentage of effort 66' selected at the respective steps illustrated in FIG. 4. Additional information can be displayed, such as the total number of pounds of the individual user, as well as the total number of calories used by the individual user during the exercise. The nature of the information displayed is a matter of design choice and additional or other information may be displayed if desired. As should be clear, the nature of display 78 as well as the information displayed therein is a function of both the sensors which sense the forces acting on the loop 22** as well as the velocity of movement as well as software programming similar to that which is suggested in the Pasierb, jr. et al. U.S. Pat. No. 4,674,741 where a video is displayed is also used to display a simulated rowing exercise in which a pacer rowing figure is displayed. During the rowing exercise, the distances separating the rowing figures depends on the user's stroke movements and on the preset pacer motion. Any person skilled in the programming art would be able to utilize programming techniques of the type shown in Pasierb, Jr. et al. U.S. Pat. No. 4,674,741.

Preferably, the video display used with the tug of war machine includes two versions of competition and would be based on the amount of force that a user could or wants to generate. The first version used is static pull which shows the user pulling opponents into a pit. The amount of force generated by the user could be measured by a dynamometer. The more force the user generates, the more opponents the user would pull into the pit. The second version used would show two tug of war competitions occurring side by side, as suggested in the screen 78 in FIG. 5. There is a pace tug of war and user tug of war, both pulling opponents into the pit. At the end of the selected time of competition, the competitor who pulls in less opponents would be destroyed in the pit.

It is also possible to select a base of competition in different ways. For example, one option is to set the pacer opponent based on categories of sex, height, and weight. This enables competition against users of similar sex and size. A participant's effort can be stored in a memory bank so that a ranking of all user's could be compiled and an ultimate champion for each category could be determined.

A second option for setting the pacer competition is to allow the user to select a percentage of the total force that is generated on the static pull. Exercising on the tug of war machine in this manner allows for continuous aerobic exercise against the user's selected resistance. It allows the participants to gradually increase the percentage of resistance to exercise and compete against.

A time exercise can be set. Accommodating resistance allows the user to continue to pull even if the effort is not above the selected setting. The video display allows the pacer competitor and the user pulling opponents into the pit. If the user exerts more than the selected resistance, the user pulls in more opponents. If the user exerts less force than the selected resistance, the pacer tug of war pulls more opponents into the pit. At the end of a selected time, the loser is destroyed.

Thus, the four modes of operation achievable with the tug of war machine are as follows:

1. Static or isometric exercise which measures the force of a horizontal pull. U.S. Pat. No. 4,842,152 to Pratt Jr. demonstrates a biofeedback vertical lift measuring device, as above noted. The vertical lift device is currently being used as a means of assessing leg and back strength. The tug of war machine of the present invention can utilize the same type of resistance measuring device. This static version of the machine consist of a non-movable cord attached to a dynamometer and integrated with a video display. The height level of the cord is advantageously adjustable to compensate for individuals of different heights.

2. A movable version of the tug of war machine has the same video display with the following added capabilities. The cord is movable, as aforementioned, to provide greater training effect. It uses an isokinetic exercise monitoring resistance device as developed by Cybex Co. The participant selects the speed setting for the cord to be pulled and measures the amount of force that is generated. Integration with the video display allows for the competition described. U.S. Pat. No. 4,565,638 to Boettcher describes isokinetic exercise and monitoring machine.

3. A movable belt of a treadmill is another option for the tug of war machine. It can be a standard treadmill that can be set to the same speed as the speed setting of the movable loop cord. It can be a motorized machine or an isokinetic device similar to the one used for the cord. In this connection, while the loop cord 22 and the treadmill belt 18 in FIG. 2 are shown coupled to each other by means of belt 22', it should be evident that this is not a critical feature and the belt 22 may be omitted so that the resistance devices 30, 38 whatever those are selected to be, can act independently on the belt 22 as well as the belt 18 of the treadmill.

4. The tug of war machine can be used in a combination of the above modes.

Many possible embodiments may be made of the invention without departing from the scope thereof, and it is to be understood that all matter herein set forth or shown in the figures of the accompanying drawings is to be interpreted as illustrative and not in the limiting sense.

I claim:

1. A tug of war exercise machine to exercise an individual in a generally upright position comprising:

stationary support means generally at a height within the range of the reach of an individual's hand while in standing exercise stance:

force responsive means on said support means to measure force exerted on said support means;

elongated pulling means in the form of a closed loop coupled to said force responsive means and available to be engaged by the individual and pulled in a generally horizontal direction away from said support and force responsive means;

resistance means operationally connected to said elongated pulling means to provide an adjustable resistance to said elongated pulling means; and indicating means cooperating with said force responsive means for providing an indication as to the effort of the individual relative to a predetermined standard or reference.

2. A tug of war exercise machine as defined in claim 1, wherein said stationary means comprises an upright console.

3. A tug of war exercise machine as defined in claim 2, wherein said indicating means includes a video monitor is housed within said console and faces the individual when pulling on said elongate pulling means.

4. A tug of war exercise machine as defined in claim 1, wherein said indicating means comprises means comprises means for producing an audio output.

5. A tug of war exercise machine as defined in claim 4, wherein said audio output has a pitch which varies with the deviation between the individual's effort and said predetermined standard or reference.

6. A tug of war exercise machine as defined in claim 4, wherein said indicating means includes means for producing synthesized audio speech output.

7. A tug of war exercise machine as defined in claim 1, wherein said force responsive means comprises means for fixing said elongate pulling means to allow the individual to isometrically pull on said elongate pulling means without movement of said elongate pulling means, said indicating means indicating the horizontal pulling force applied by the individual.

8. A tug of war exercise machine as defined in claim 1, wherein said elongate pulling means comprises a cord or cable mounted for movement relative to said support means, and tension control means for applying a tension to said cord or cable as a function of the pulling forces applied by the individual, whereby the individual can pull, said cord or cable in a hand-over-hand movement to stimulate a tug of war contest.

9. A tug of war exercise machine as defined in claim 8, wherein said tension control means comprises means to provide an isotonic force relationship which maintains a substantially equal tension on said cord or cable independently of the velocity or speed with which said cord or cable is pulled.

10. A tug of war exercise machine as defined in claim 8, wherein said tension control means comprises means to provide an isokinetic force relationship which maintains a substantially constant velocity of said cord or cable independently of the force applied to said cord or cable.

11. A tug of war exercise machine as defined in claim 1, further comprising a treadmill having a belt upon which the individual stands when pulling said elongated pulling means; and means for enabling the portion of said treadmill belt upon which the individual stands to move in the direction of said stationary support means, whereby the individual experiences a backward walking motion while pulling said elongated pulling means.

12. A tug of war exercise machine as defined in claim 11, further comprising for coupling of said treadmill to said indicating means, whereby said indicating means illustrates the efforts of the individual as a function of the velocity of movement of said treadmill.

13. A tug of war exercise machine as defined in claim 1, wherein said indicating means comprises input means for receiving information in predetermined categories for purposes of establishing said predetermined standard for reference.

14. A tug of war exercise machine as defined in claim 1, further comprising timer means for timing the duration of the exercise.

15. A tug of war machine as defined in claim 1, further comprising a treadmill coupled to said elongated pulling means; clutch means coupled to said elongate pulling means and to said treadmill for selectively engaging and disengaging said elongated pulling means from said treadmill, whereby said elongated pulling means and said treadmill can operate both independently and simultaneously.

16. A tug of war exercise machine as defined in claim 1, further comprising a video monitor; and microprocessor means coupled to said video monitor and said force responsive means for showing opponents isometrically pulling on said elongated pulling means and being pulled into a pit as the force applied by the individual increases.

17. A tug of war machine as defined in claim 1, further comprising a video monitor; microprocessor means coupled to said video monitor and said force responsive means for showing opponents isokinetically pulling on said elongated pulling means and being pulled into a pit as the effort applied by the individual increases.

18. A tug of war machine as defined in claim 1, further comprising a video monitor; microprocessor means coupled to said video monitor and said force responsive means for showing opponents isotonically pulling on said elongated pulling means and being pulled into a pit as the effort applied by the individual increases.

19. A tug of war machine as defined in claim 1, further comprising a video monitor; microprocessor means coupled to said video monitor and said force responsive means for showing opponents accommodating resistively pulling on said elongate pulling means and being pulled into a pit as the effort applied by the individual increases.

20. A tug of war exercise machine as defined in claim 1, wherein said force responsive means includes braking means for braking said elongated pulling means.

* * * * *